US005588774A

United States Patent [19]

Behan

[11] Patent Number: 5,588,774

[45] Date of Patent: Dec. 31, 1996

[54] APPARATUS FOR ARRESTING THE PROGRESS OF VEHICLES

[75] Inventor: Kevin Behan, Watford, United Kingdom

[73] Assignee: CatsClaw Limited, St. Albans, United Kingdom

[21] Appl. No.: 199,324

[22] PCT Filed: Sep. 1, 1992

[86] PCT No.: PCT/GB92/01598

§ 371 Date: May 4, 1994

§ 102(e) Date: May 4, 1994

[87] PCT Pub. No.: WO93/05236

PCT Pub. Date: Mar. 18, 1993

[30] Foreign Application Priority Data

Sep. 3, 1991 [GB] United Kingdom ..... 9118817
Nov. 13, 1991 [GB] United Kingdom ..... 9124137

[51] Int. Cl.[6] ..... E01F 13/00
[52] U.S. Cl. ..... 404/6
[58] Field of Search ..... 404/6–11, 15; 116/63, 63 P

[56] References Cited

U.S. PATENT DOCUMENTS

| | | | |
|---|---|---|---|
| 3,844,667 | 10/1974 | Fitton-Kearns . | |
| 4,097,170 | 6/1978 | Dickinson | 404/6 |
| 4,318,079 | 3/1982 | Dickinson . | |
| 4,998,843 | 3/1991 | Mothe | 404/6 |

FOREIGN PATENT DOCUMENTS

| | | |
|---|---|---|
| 2605655 | 4/1988 | France . |
| 2607162 | 5/1988 | France . |

*Primary Examiner*—Roger J. Schoeppel
*Attorney, Agent, or Firm*—Christie, Parker & Hale, LLP

[57] ABSTRACT

An apparatus comprising a plurality of releasably connected modules adapted to be placed on a road surface for arresting the progress of a vehicle. Each module is equipped with a number of blades which can be protruded or retracted to respectively arrest or allow the passage of vehicle thereover. The modules are interconnected in a manner which enables simultaneous actuation of all the blades and compensates for the camber of the road surface or the misalignment of the modules.

15 Claims, 6 Drawing Sheets

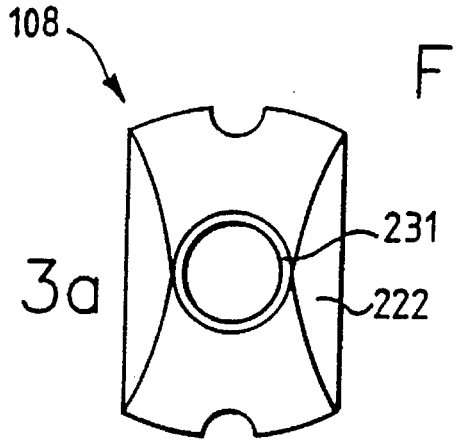
FIG. 13a
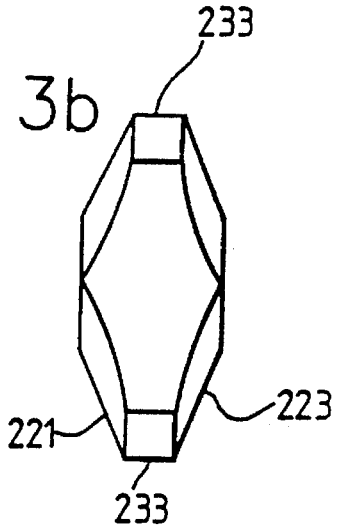
FIG. 13b
FIG. 13c
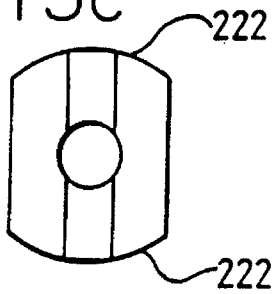
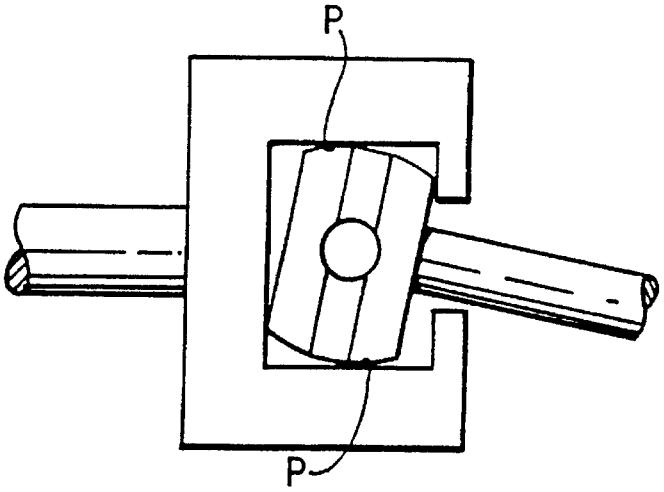
FIG. 14.

APPARATUS FOR ARRESTING THE PROGRESS OF VEHICLES

This invention relates to an apparatus for arresting progress of vehicles. In particular, it relates to an apparatus which may be placed on a road surface, at a position in which vehicles must pass over the apparatus, the apparatus having a means for selectively arresting the progress of selected vehicles so as to prevent such vehicles from passing. Such an apparatus is useful when it is required to check the identity of certain vehicles and/or vehicle occupants and to not allow certain ones of these to pass.

Conventional methods of checking the identity of vehicles or vehicle occupants require the checker to manually flag down and stop each vehicle he wishes to investigate. This can of course be dangerous and ineffective if a particular vehicle/occupant does not want to be identified since he can merely drive past the checker, perhaps knocking him over and injuring him in the process. Barrier methods are known in which barriers are installed and each vehicle is temporarily stopped by the barrier until allowed to pass or not. This can, however, significantly impede the flow of traffic when the great majority of the traffic is not required to be stopped. Significant delays to innocent vehicle occupants can be incurred.

The present invention arose in an attempt to provide an improved apparatus for selectively arresting the progress of certain vehicles but which allows substantially unimpeded progress for other vehicles.

According to the present invention there is provided apparatus for selectively arresting the progress of vehicles; comprising a plurality of releasably connected modules, each module being shaped to lie on a road surface to allow the passage of a vehicle thereover, and having vehicle arresting means moveable between a retracted position inside the module and an operative position in which the means protrudes from the module to prevent progress of a vehicle, the modules being interconnected by a means which enables simultaneous actuation of all the arresting means; the means comprising male and female connectors; each male connector comprising a member-adapted to locate in a cavity or channel in a female connector and including cooperating means such that rotation of the male member causes rotation of the female connector, wherein the male and female connectors are configured to allow at least one degree of free play therebetween.

Preferably, the apparatus is adapted such that the modules can only be interconnected when the arresting means are in the retracted position.

BRIEF DESCRIPTION OF THE DRAWING

Embodiments of the invention will now be described, by way of example only, with reference to the accompanying drawings, in which:

FIG. 13 consisting of FIGS. 13*a*, 13*b* and 13*c*, shows respective front, side and end views of a further alternative male end; and FIG. 14 shows the male end of FIG. 13 coupled to a female end.

DETAILED DESCRIPTION

Figure 1A:
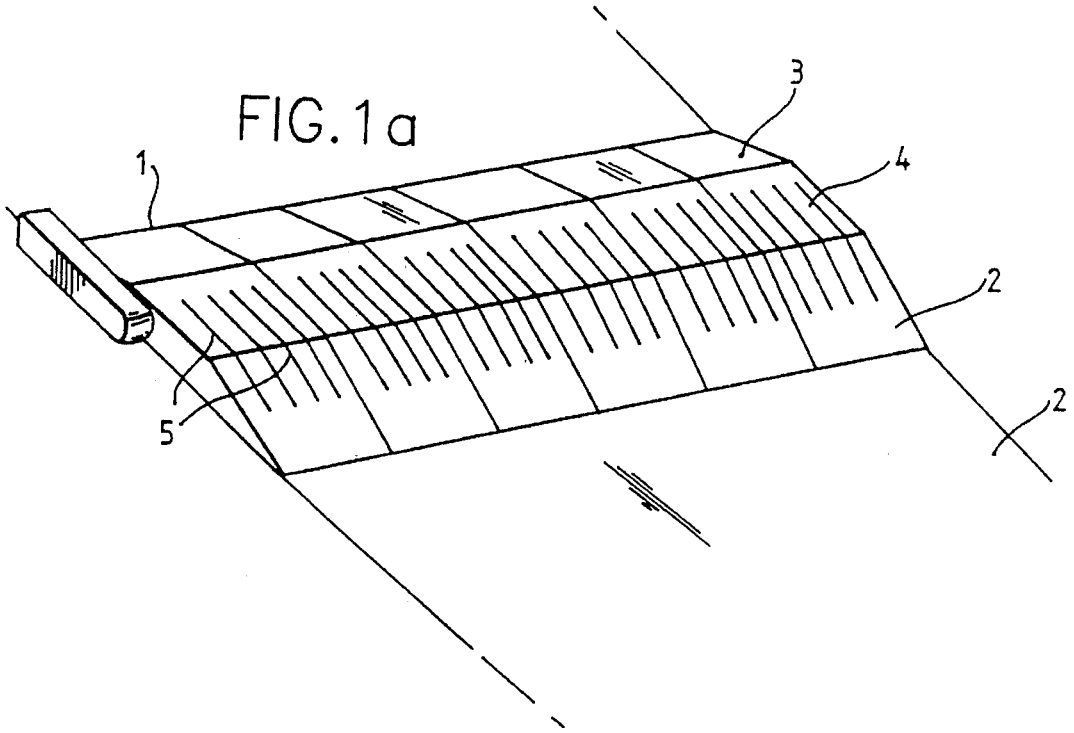
FIG. 1 consisting of FIGS. 1*a* and 1*b* shows an apparatus for spanning a road surface indicating at (a) a state in which vehicles may travel over the device and (b) a state in which the vehicle's movement would be arrested by the device.
Figure 1B:
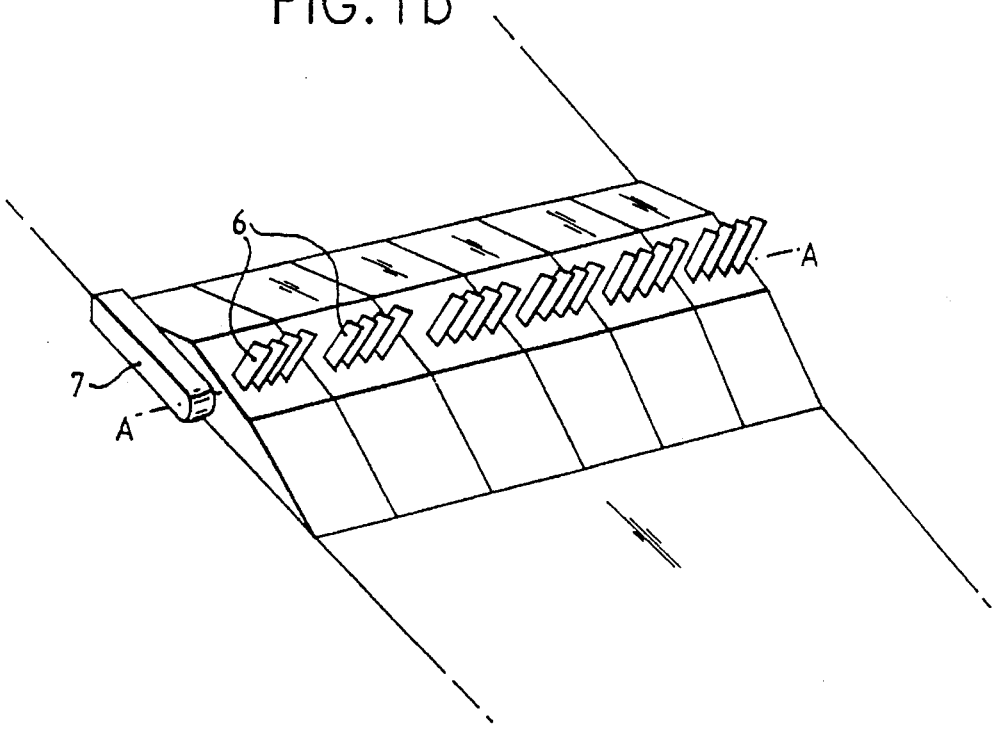

Referring to FIG. 1 a device for allowing the passage of certain vehicles thereover but preventing or arresting the passage of certain selected other vehicles comprises a plurality of separate modules 1 connected end to end across a road surface such as 2. Each module has front and rear tapered portions and an intermediate generally horizontal portion (by which is meant generally parallel to the road surface) 4 so that a vehicles tyres can safely cross the interconnected modules by riding up front surface 2, which may have an angle of perhaps 30° with respect to the road surface, along portions 4 and down portion 3. Devices of this type are well known per se and are often referred to as "sleeping policemen". They are useful for limiting the speed of vehicles.

A plurality of parallel slots 5 are formed in each module, each slot extending forwardly from a position on the intermediate portion 4 of each module to a position in the front portion 2 as shown. A similar plurality of blades 6 (FIG. 1(*b*)) are mounted within the modules in such a manner that the blades can be rotated about a common axis A from a first retracted position in which they are wholly within the modules, generally parallel to the road surface and facing in the direction of end 2, to a position in which, as shown in FIG. 1(*b*) the blades protrude from the modules. The blades are sufficiently sharp and are so designed as to cut or slash a vehicles tyres to arrest progress of a vehicle. In the first position the blades do not protrude from the device so that a vehicle may pass unhindered. The blades are commonly mounted such that they all can be actuated or deactuated simultaneously by a control unit 7. This may be a manual unit such as a lever which is rotated about 90° or (preferably) the blades may be controlled electronically, pneumatically or hydraulically for example. In a preferred embodiment, the controller 7 is actuated remotely by means of a wire (not shown) or wireless link leading to a remote control unit. Thus, when a roadblock is in progress the interconnected modules may be placed a few metres beyond the place where vehicle occupants are being checked. If a vehicle and its occupants are satisfactory, then the car is allowed to drive on and pass unimpeded over the blocks. If the vehicle is suspect or the occupant attempts to make a sudden get-away the checker may actuate remotely the blades. When that vehicle passes the blades, they are in their protruding position and hence efficiently arrest its progress.

Figure 2:
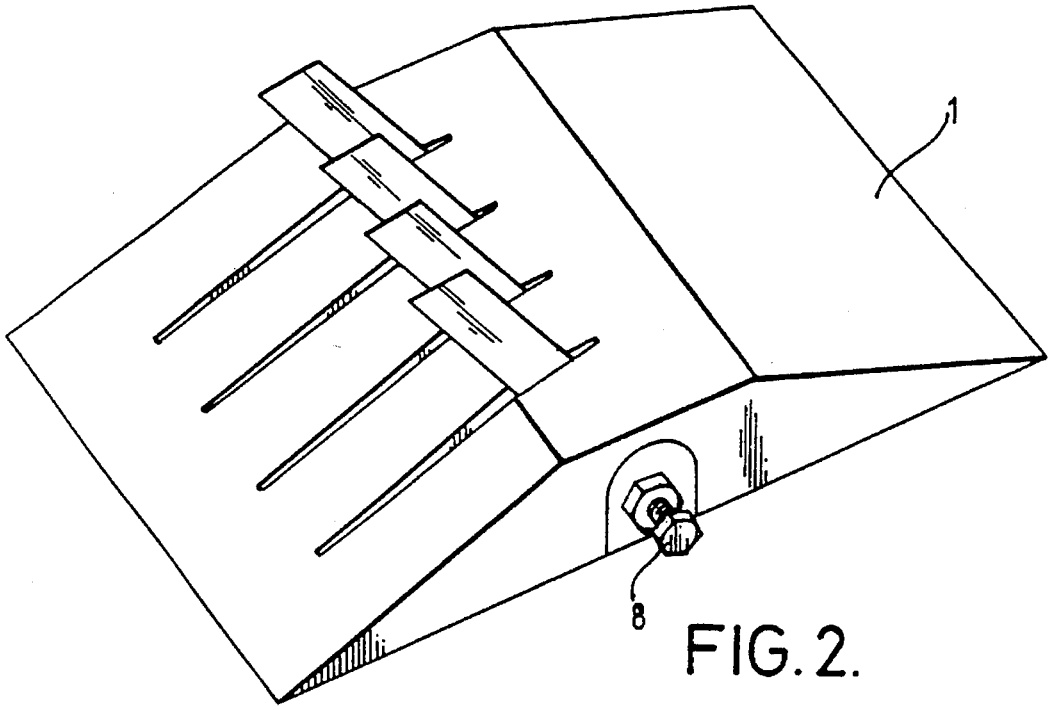
FIG. 2 shows two separate modules of the device.
Figure 3:
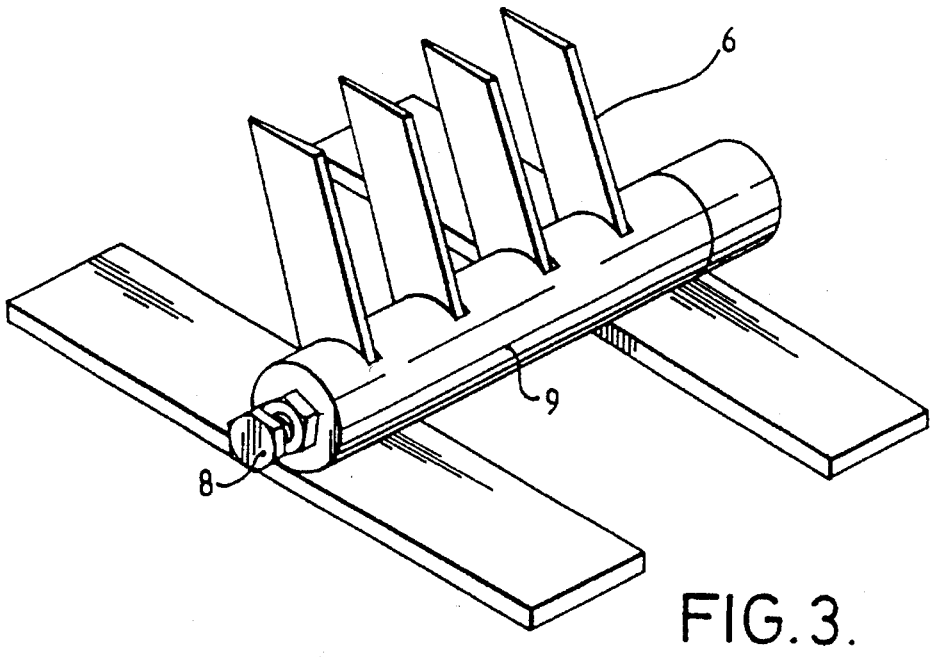
FIG. 3 shows the manner in which vehicle arresting blades may be assembled in a module.

FIG. 2 shows one of the modules 1 indicating part of the mechanism for connecting it with an adjacent module. The connecting means essentially comprises respective male and female connectors of which a male end is shown in FIG. 2 (the unseen end of the module comprises a female connector). This male connector comprises a nut 8 which may be received in a suitable nut receiving cavity. As shown in FIG. 3 nut 8 is associated with a shaft 9 which carries the array of blades 6. Thus, when nut 8 is received into the female nut receiving cavity and rotated it causes rotation of shaft 9 on the next module which accordingly raises the array of blades 6 from their rest position withdrawn inside the module housing 1 to their active position shown in FIG. 2 where they protrude from the housing.

Figure 4:
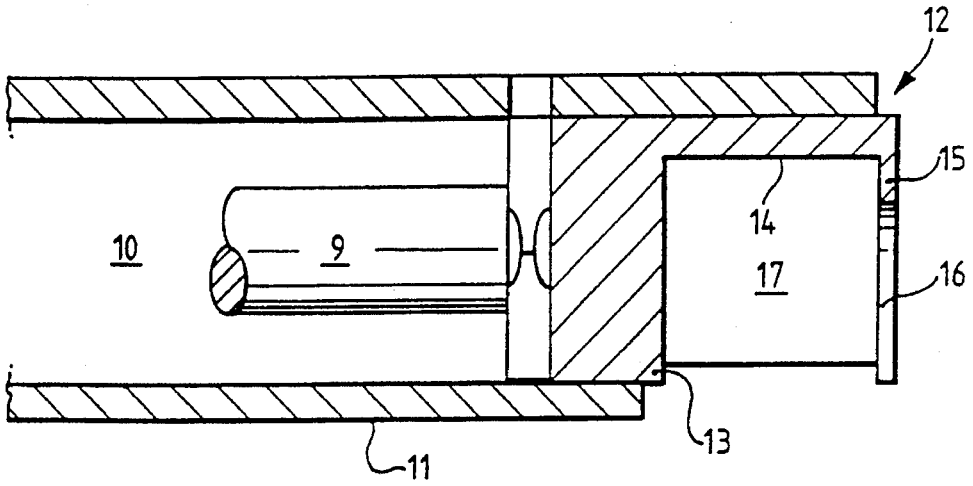
FIG. 4 shows the female mating end of a module.
Figure 5:
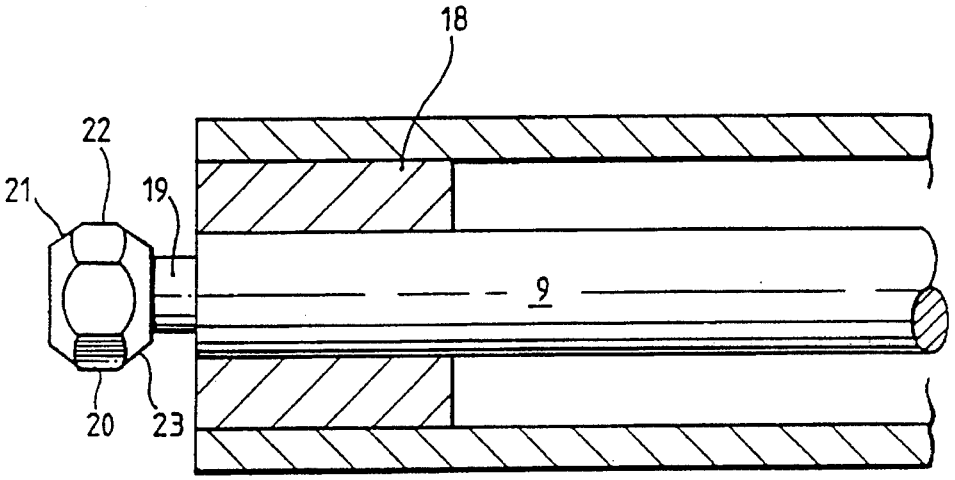
FIG. 5 shows the male mating end.
Figure 6:
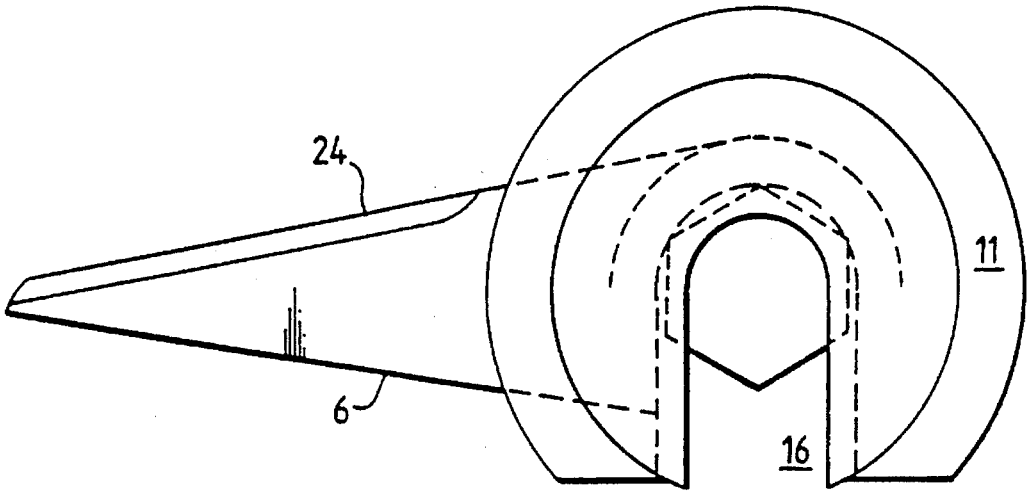
FIG. 6 shows a cross section through a male-female joint at the time of mating.

FIGS. 4 and 5 show in more detail respective female and male connecting ends. FIG. 6 also shows an end view of the female end of the module. Referring to FIG. 4 the module is shown as having an elongate cavity formed by a wall 10 having an opening at one end of its bottom surface. The shaft 9 is mounted within the cavity and is connected to a rotatable end piece 12. Piece 12 has a rear end in the form of a disc 13 of diameter similar to the diameter of the hollow cylindrical cavity 10 in which the shaft rotates. An elongate portion 14 of arcuate cross section, having a longitudinal opening extends from disc 13 away from shaft 9 and an inwardly facing lip 15 is provided at the end of part 14. This is perhaps more clearly shown in FIG. 6. The radially innermost part of lip 15 is of a U shape. The lip accordingly forms a slot 16 in front of an arched cavity 17. At least part of portion 14 is shaped to cooperate with the flat polygonal section portions of a nut, so that rotation of a nut inserted into cavity 17 causes rotation of rotatable member 12 and hence of shaft 9.

FIG. 5 shows the male end of a module. The shaft 9 is spaced from the walls of a module by a bush 18 at one end, the shaft being rotatable with respect to the bush. A pin or bolt extends longitudinally from the end of the shaft and integral with this is a nut 20. Nut 20 is shaped to cooperate with the internal surface of member 12 so that rotation of the nut causes cooperative rotation of the member.

As shown in FIG. 5, the nut has a frustoconical front portion 21, an intermediate portion of polygonal (typically hexagonal) cross section having flat faces and a rear portion 23, of frustoconical shape. The width of the flat portion 22, with regard to the frustoconical portions, is sufficient to compensate for major misalignment of two adjacent modules but is wide enough to utilize this misalignment to gather up the backlash caused by the necessary clearance between the male and female fittings. Thus, it assists blade alignment during wide span use, that is, use of a relatively large number of modules joined end to end across a road surface. As shown in FIG. 13, the 'flat' portions may be arcuate in cross section.

Typical module dimensions are 400×250×60 mm.

In use, a first module is placed in the required position on the ground. The second module is then positioned higher than the first module at a position where cavity 17 overlays nut 20. By lowering the second module the nut is received in the nut receiving cavity 17. The play between the two members enables relatively easy alignment to be made. The remaining modules required are progressively interconnected in the same manner. In use, when actuation of the device is required, actuation of the shaft at one end of the interconnected modules causes rotation of each respective nut 20, and hence driven rotation of each subsequent shaft 9 in the chain. This causes rotation of each shaft to the position shown in FIG. 7. It should be noted from this figure that rotation of the nut 20 and member 12 causes the slot 16 to be rotated so that it does not lie in line with the opening in outer member 10. Thus, the nut is entrapped within cavity 17 and cannot be released therefrom when the blades are actuated. This is also a safety feature since it means that the modules cannot be initially connected unless all the slots face downwardly (i.e., toward the road surface) and thus all the blades are retracted in the position shown in FIG. 6.

Figure 8A:
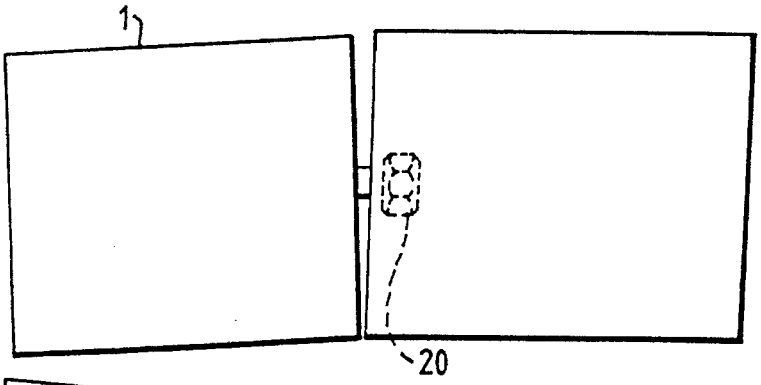
FIG. 8 consisting of 8*a* and 8*b*, shows modules connected in misalignment.
Figure 8B:
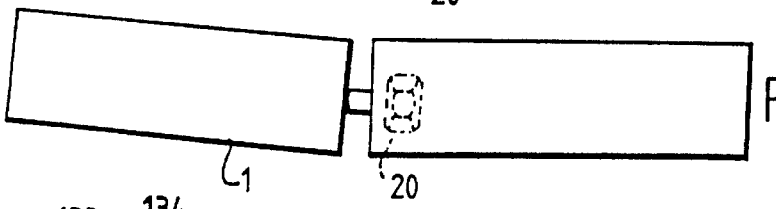

FIG. 8 shows how the coupling mechanism enables adjacent modules to be aligned in a misaligned fashion, as can be useful when the road surface is uneven, for example, or has a variable camber. FIG. 8(*a*) shows how misalignment in the horizontal plane is allowed for and FIG. 8(*b*) shows how misalignment in camber or road angle can be compensated for. In each case, a firm joint is obtained even though the adjacent modules are misaligned.

Figure 7:
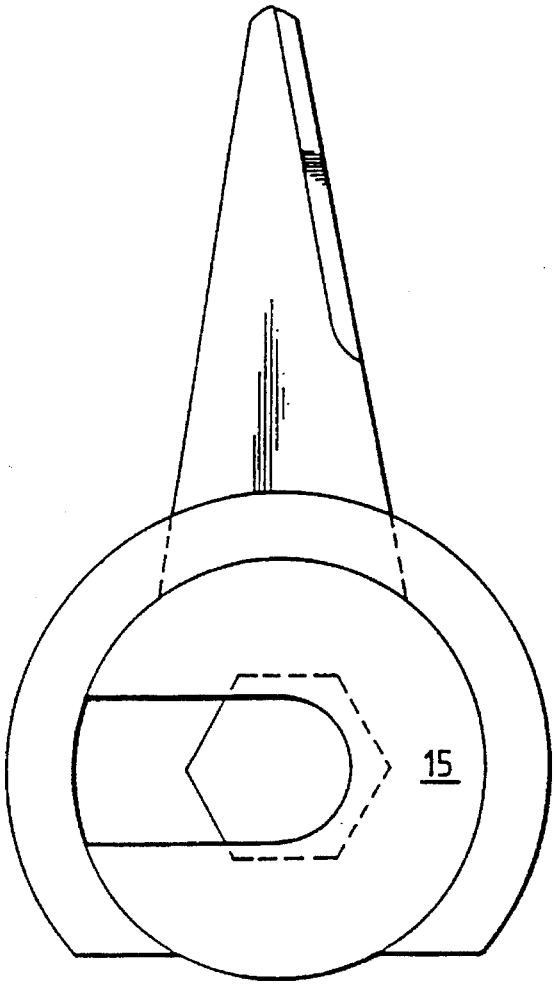
FIG. 7 shows the joint when rotated into a vehicle arresting position.

FIGS. 6 and 7 illustrate one example of a blade. This blade includes a longitudinal channel in the form of a fluted portion 24. In use, the fluted portion improves the effectiveness of the blade since, after the blade has cut a vehicles tyre it provides a passage for air to escape from the tyre, thus increasing the likelihood and speed of vehicle disablement. Any other type of blade may be used, and in other embodiments the blades may be replaced by other vehicle arresting means. An example of these is a flat plate over which a vehicle cannot pass. Other examples will be apparent.

Figure 9A:
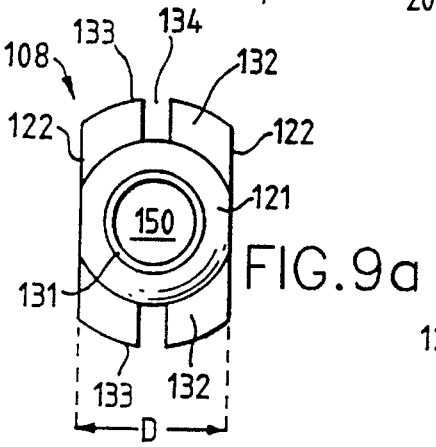
FIG. 9 consisting of FIGS. 9*a* and 9*b*, shows front and side views of an alternative male mating end.
Figure 9B:
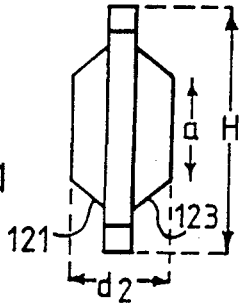

FIGS. 9 to 12 illustrate an alternative embodiment of the coupling mechanism. A male coupling part 108 is shown in FIG. 9 and comprises front and rear frustoconical portions 121 and 123. The part includes a through bore 150 for receiving the shaft 19. Where the bore meets the truncated apexes of the frustoconical portions, planar, annular and, abutment surfaces 131 are formed. The flat portions of the male part, for cooperating with the female part, are formed by two parallel edges 122 of a portion intermediate the frustoconical portions with the edges 122 being tangential thereto. Flat edges 122 form part of two radially spaced wings 132 extending on diametrically opposite sides of the frustoconical portions. The edges of each wings are formed by flats 122 and an arcuate end edge 133. In the embodiment shown, a further through bore 134 is formed, extending between the two wings and perpendicularly inserting bore 150. Thus, each wing 132 is divided into two portions as shown. Bore 134 may receive a means such as a pin or bolt (135 in FIG. 12) for securing member 108 to shaft 9.

Figure 10:
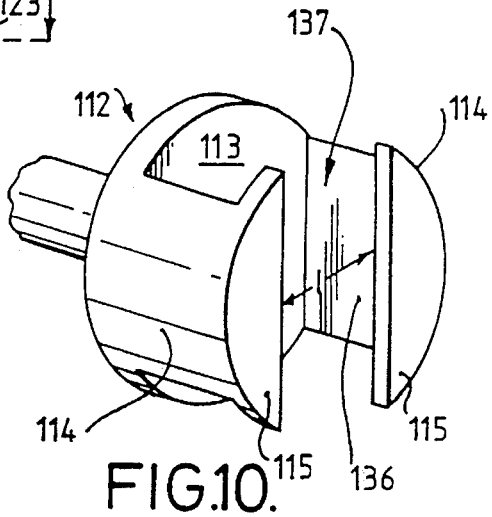
FIG. 10 shows part of an alternative female mating end.
Figure 11:
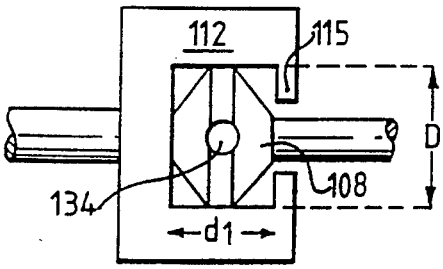
FIGS. 11 and 12 show the ends of FIGS. 9 and 10 when coupled.

FIG. 10 shows the female coupling part 112. This part has a disk shaped rear wall 113 from which extend two identical projections 114. The projections have an annular outer surface following the peripheral curve of wall 113 but have a straight inner wall 135 to form solid segments, defining, between them, a channel 137 having parallel side walls and extending from the top to the bottom, for example of the part 112. Respectively lips 115 are formed at the distal ends of projections 114, which lips extend perpendicularly to the projections into the channel, to partially close the entrance to the channel, as is shown more clearly in FIG. 11.

To effect coupling between the two parts the female part, which is held captive but rotatable in a module in the manner shown in FIG. 4, is placed over the male part and moved down to entrap the male part 108. The frustoconical portions of part 108 facilitate the insertion, since they enable the parts to slidably couple if misaligned. It has been found that up to 20, or more, couplings can be made in one minute. Thus, usually, an entire road width can be secured in less than one minute. The width D of channel 137 is arranged to be approximately equal, or slightly greater than the width of part 108 so that a snug fit is obtained. When part 108 is rotated, it causes rotation of female part 112, which brings the open end of channel 137 out of alignment with the opening in outer member 10.

Figure 12:
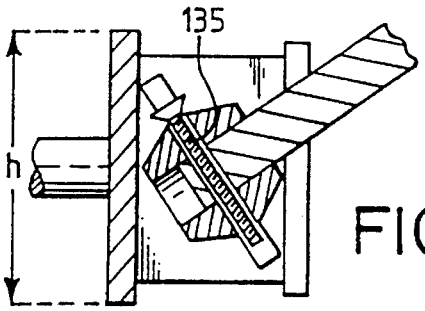

As shown in FIG. 12, which is an exaggerated side cross-sectional view, the tolerance of the joint allows a large variance in the relative angles of two adjacent modules. In effect, in the vertical plane, the male part 108 can be tilted until a wing portion abuts the inside of a lip 115, or against rear wall 113. The male and female parts are therefore dimensioned to allow for this tilting. This may be done in several different ways, for example, by having the depth $d_1$ of the channel larger than the depth $d_2$ of the male part 108; by having the opening between the lips 115 greater than the circumference of annular opening 131 but smaller than the width D (or diameter of the frustoconical portions 121,123) so that a frustoconical portion may protrude slightly from the rear surface of the lips to facilitate tilting; by arranging for the height H of part 108 to be smaller than the diameter of disk 113, by any combination of these or by any other way.

The male part 108 need not include frustoconical portions, instead these could be cylindrical front and rear protrusions, or be of other configurations.

The female part may have a polygonal section portion, for example, a hexagonal section, at its rear, having an axial through bore for receiving shaft 9. Alternatively, the shaft may terminate in a polygonal section portion which fits over the polygonal section of the female connector, to be rotated thereby.

In one example, the dimensions of the connectors may be as follows (±2 mm). H=30 mm, D=22 mm, $d_1$=13 mm, $d_2$=14 mm, h=37 mm, l=17 mm. a=16 mm.

A further alternative construction of the male part 108 is shown in FIGS. 13 and 14. This part can facilitate easier coupling of the male and female parts so that the modules may be more rapidly assembled in an emergency situation. As shown in FIG. 13, alternative male end 108 does not include wing portions as such but instead, the 'frustoconical' portions (which are not strictly frustoconical in this example, being of different cross sections in different orthogonal planes) 221 and 223 extend from the central annular regions 231 to the edges 233 of the structure. The other main difference is that instead of flat portions 122 the edges of the portions intermediate the frustoconical portions are radiused (i.e. of arcuate cross section) as shown in FIG. 13(*c*) at 222. Hence, in plan view, the male member has two opposed arcuate edges as shown. The two radiused edges 222 are preferably arcs of a circle having its centre through the transverse axis of the member. They may be curved to the edges of angular abutment surfaces 231 or only part of the way thereto.

FIG. 14 shows a top view of the male member of FIG. 13 when coupled to a female member. As shown, the contact between the side faces 222 of the male member and the internal surfaces of the sides of the channel in the female member occur along two opposed vertical lines P (which extend into the paper in the figure). Thus, the male member may be more tightly fitted into the female member but is still free for rotation provided respective opposing parts of the arcuate regions 222 contact the side walls of the female channel. This makes it easier to locate the female portion over a male portion to couple two modules since the male portion is of constant diameter throughout the curved extent of arcuate regions 222 and thus, provided a portion of the curved ends is received by the side walls of the female channel, the male member will easily locate even if it is angled with respect to the female member. On the other hand with the member of FIG. 9 on the other hand, in which the edges 122 are planar, this is only possible if a large tolerance is allowed between the width of the male member and the width of the female channel, otherwise location is only possible when the male member lies squarely at 90° to the channel.

It will be appreciated that the relative angles to both the horizontal and vertical planes of the two members may vary in this example. Techniques such as those described with reference to FIGS. 9 to 12 may also be used with this example to allow for relative tilting caused by misalignment of modules, or camber or uneven slope of a road, for example.

The configuration of FIGS. 13 and 14 enables very rapid assembly of an arresting structure. Typically, an assembly covering the width of a road may be assembled/dismantled in under two minutes. This has obvious advantages where a security force has only short notice of a suspect vehicle approaching. Since the tolerance of the male member with the female one can be tighter in this embodiment, but can still allow large differences in angle (both horizontal and vertical) during interconnection, less free play arises when progressive blade structures are rotated and all the blades in a relatively long structure can easily be concertedly raised or lowered. In one trial, up to thirty modules have been connected to each side of a control unit 7 (it will be appreciated that the control unit may be located anywhere in the assembly, not just at one end and could have two 'outputs'). Thus, sixty or more modules may be satisfactorily operated in unison. Consequently, both carriageways of a motorway could be protected.

I claim:

1. Apparatus for selectively arresting the progress of vehicles, comprising: a plurality of releasably connected modules, each module being shaped to lie on a road surface to allow the passage of a vehicle thereover, and having vehicle arresting means moveable between a retracted position inside the module and an operative position in which the arresting means protrudes from the module to prevent progress of the vehicle, the modules being interconnected by an actuating means which enables simultaneous actuation of all the arresting means, the actuating means comprising male and female connectors, each male connector comprising a member adapted to locate in a female connector and including cooperating means such that rotation of the male member causes rotation of the female connector, wherein the female connector comprises a channel into which the male member is received, the channel having a lip portion for preventing axial removal of the male connector and the distance from a base of the channel to the plane of the lip being greater than the depth of at least a portion of the part of the male member which, in situ, is located directly between the lip and base to allow limited axial and/or tilting movement of the male member in the channel.

2. Apparatus as claimed in claim 1 wherein the male member comprises peripheral edges of reduced depth relative to a central portion of said member, the depth of the peripheral edges being less than the distance from the base of the channel to the plane of the lip to allow relative tilting of the male member.

3. Apparatus as claimed in claim 1 wherein the channel comprises parallel side walls and wherein a portion of the edges of the male member which contact the side walls are cylindrical so that the male connector can tilt relative to the female connector about an axis parallel to the side walls.

4. Apparatus as claimed in claim 3 wherein the male connector comprises a front having at least a partially frustoconical portion and an intermediate portion having the cylindrical edges which abut the side walls of the channel.

5. Apparatus as claimed in claim 3 wherein the male connector comprises a rear having at least a partially frustoconical portion and an intermediate portion having the cylindrical edges which abut the side walls of the channel.

6. Apparatus as claimed in claim 3 wherein the male connector has a front having at least a partially frustoconical portion and having two parallel edges generally tangential to a base of the frustoconical portion which forms two radially spaced wing portions adapted to abut against a portion of the female connector to limit angular free play in at least one plane.

7. Apparatus as claimed in claim 3 wherein the male connector has a rear having at least a partially frustoconical portion and having two parallel edges generally tangential to a base of the frustoconical portion which forms two radially spaced wing portions adapted to abut against a portion of the female connector to limit angular free play in at least one plane.

8. Apparatus as claimed in claim 1 wherein the female connector is rotatable within an outer casing, the female connector having an opening on one edge of its channel through which the male connector can be introduced, said opening being arranged to be in register with an opening in the outer casing for enabling the introduction of the male connector when the connectors are in a first configuration, and to be movable out of register to hold the male connector captive.

9. Apparatus as claimed in claim 8 wherein the connectors are connected to the vehicle arresting means in such a manner that when the openings are in register the arresting means are retracted.

10. Apparatus as claimed in claim 1 wherein the vehicle arresting means are blades.

11. Apparatus as claimed in claim 10 wherein the blades are fluted.

12. Apparatus as claimed in claim 1 wherein the male member comprises at least a partially frustoconical portion having a truncated apex, and wherein the lip portion of said female connector comprises a pair of lips, the distance between them being greater than the diameter of the truncated apex of the frustoconical portion.

13. Apparatus as claimed in claim 12 wherein the truncated apex of the frustoconical portion extends beyond the plane of the lips to facilitate relative tilting.

14. Apparatus as claimed in claim 1 wherein the largest diameter of the male connector is less than the length of the channel.

15. Apparatus for selectively arresting the progress of vehicles, comprising: a plurality of releasably connected modules, each module being shaped to lie on a road surface to allow the passage of a vehicle thereover, and having vehicle arresting means moveable between a retracted position inside the module and an operative position in which the arresting means protrudes from the module to prevent progress of the vehicle, the modules being interconnected by an actuating means which enables simultaneous actuation of all the arresting means, the actuating means comprising male and female connectors, each male connector comprising a member adapted to locate in a female connector and including cooperating means such that rotation of the male member causes rotation of the female connector, wherein the female connector comprises a channel into which the male member is received, the channel having parallel side walls and wherein a portion of the edges of the male member which contact with the side walls are part cylindrical so that the male connector can tilt relative to the female connector.

* * * * *